US011772953B2

(12) United States Patent
Taylor et al.

(10) Patent No.: US 11,772,953 B2
(45) Date of Patent: Oct. 3, 2023

(54) AUTOMATIC WATER DISPENSER FOR REFRIGERATOR

(71) Applicant: Electrolux Home Products, Inc., Charlotte, NC (US)

(72) Inventors: John W. Taylor, Cornelius, NC (US); Stephen Smith, Waxhaw, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 122 days.

(21) Appl. No.: 16/901,362

(22) Filed: Jun. 15, 2020

(65) Prior Publication Data

US 2021/0387845 A1 Dec. 16, 2021

(51) Int. Cl.

| | |
|---|---|
| ***B67D 1/08*** | (2006.01) |
| ***B67D 1/12*** | (2006.01) |
| ***F25C 5/20*** | (2018.01) |
| ***F25D 23/12*** | (2006.01) |

(52) U.S. Cl.

CPC ..... *B67D 1/1236* (2013.01); *F25C 5/22* (2018.01); *F25D 23/126* (2013.01); *F25C 2400/10* (2013.01)

(58) Field of Classification Search

CPC .. B67D 1/0888; B67D 1/1236; B67D 1/1238; B67D 1/0858; F25D 23/126; F25C 2400/1033; F25C 5/22

USPC ..... 141/198, 94, 192; 222/52, 64, 1; 62/389

See application file for complete search history.

(56) References Cited

U.S. PATENT DOCUMENTS

| | | | | |
|---|---|---|---|---|
| 4,437,497 | A * | 3/1984 | Enander | G01F 23/2962 141/70 |
| 6,789,585 | B1 | 9/2004 | Janke | |
| 7,201,005 | B2 | 4/2007 | Voglewede et al. | |
| 7,210,601 | B2 | 5/2007 | Hortin et al. | |
| 7,661,448 | B2 | 2/2010 | Kim et al. | |
| 7,673,661 | B2 * | 3/2010 | Chase | B67D 1/1236 141/360 |
| 7,743,801 | B2 | 6/2010 | Janardhanam et al. | |
| 8,028,728 | B2 | 10/2011 | Cooper | |
| 8,109,301 | B1 * | 2/2012 | Denise | G07F 9/023 141/360 |
| 8,167,004 | B2 * | 5/2012 | Lee | G01F 23/2962 141/198 |

(Continued)

FOREIGN PATENT DOCUMENTS

KR 20180109259 10/2018

*Primary Examiner* — Charles P. Cheyney

(74) *Attorney, Agent, or Firm* — Pearne & Gordon LLP

(57) ABSTRACT

A method for automatically filling a container with water and/or ice from a dispenser in a refrigerator door or within a refrigerator cavity includes the steps of: placing a container adjacent the dispenser; determining a volume of the container by using a camera associated with the dispenser, capturing a picture of the containing, visually estimating a volume of the container via a microprocessor associated with the camera or a cloud-based application associated with the camera, and converting the estimated container volume to an estimated weight based on densities of water and/or ice; filling the container with water and/or ice from the dispenser based on the estimated weight; and terminating filling of the container based on the estimated weight. And the refrigerator carrying out the method.

7 Claims, 3 Drawing Sheets

(56) References Cited

U.S. PATENT DOCUMENTS

| | | | | |
|---|---|---|---|---|
| 8,245,735 | B2 * | 8/2012 | Chase | B67D 1/001 141/141 |
| 8,322,384 | B2 * | 12/2012 | Ashrafzadeh | B67D 1/1243 141/351 |
| 8,327,889 | B2 | 12/2012 | Ashrafzadeh et al. | |
| 8,813,794 | B2 * | 8/2014 | Ashrafzadeh | G07F 13/065 141/94 |
| 9,085,453 | B2 | 7/2015 | McMahan et al. | |
| 9,663,343 | B2 | 5/2017 | Veldhi et al. | |
| 9,671,156 | B2 | 6/2017 | Hwang et al. | |
| 9,719,720 | B2 * | 8/2017 | Seo | F25D 29/00 |
| 10,119,752 | B2 * | 11/2018 | Jeong | F25D 23/126 |
| 10,489,868 | B2 * | 11/2019 | Long, II | G06Q 50/12 |
| 10,858,235 | B2 * | 12/2020 | Jung | B01D 35/04 |
| 10,894,707 | B2 * | 1/2021 | Pohl | B67D 1/0888 |
| 11,117,794 | B2 * | 9/2021 | Candido De Lima Junior | B67D 1/0888 |
| 2006/0123994 | A1 * | 6/2006 | Greiwe | A47J 31/525 99/275 |
| 2006/0238346 | A1 * | 10/2006 | Teller | G01G 23/3735 340/572.1 |
| 2009/0314801 | A1 * | 12/2009 | Ashrafzadeh | B67D 1/0888 222/64 |
| 2017/0167783 | A1 * | 6/2017 | Jeong | F25D 23/028 |
| 2018/0162713 | A1 | 6/2018 | Sakthivel et al. | |
| 2020/0208904 | A1 * | 7/2020 | Choy | F25D 23/126 |

* cited by examiner

AUTOMATIC WATER DISPENSER FOR REFRIGERATOR

FIELD OF THE INVENTION

The invention is directed to a method and refrigerator for automatically filling a container from a water dispenser.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored. The freezer compartment is where food items that are to be kept in a frozen condition are stored. The refrigerators are provided with refrigeration systems that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment can be accessed without exposing the other compartment to the ambient air.

Additionally, many refrigerators include a dispenser for water and/or ice. These dispensers are typically filled by visual observation of the operator and some have automatic filling algorithms. There is a need for better automatic filling dispensers.

SUMMARY OF THE INVENTION

A method for automatically filling a container with water and/or ice from a dispenser in a refrigerator door or within a refrigerator cavity includes the steps of: placing a container adjacent the dispenser; determining a volume of the container by using a camera associated with the dispenser, capturing a picture of the container, visually estimating a volume of the container via a microprocessor associated with the camera or a cloud-based application associated with the camera, and converting the estimated container volume to an estimated weight based on densities of water and/or ice; filling the container with water and/or ice from the dispenser based on the estimated weight; and terminating filling of the container based on the estimated weight. And the refrigerator carrying out the method.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DESCRIPTION OF THE INVENTION

Figure 1:
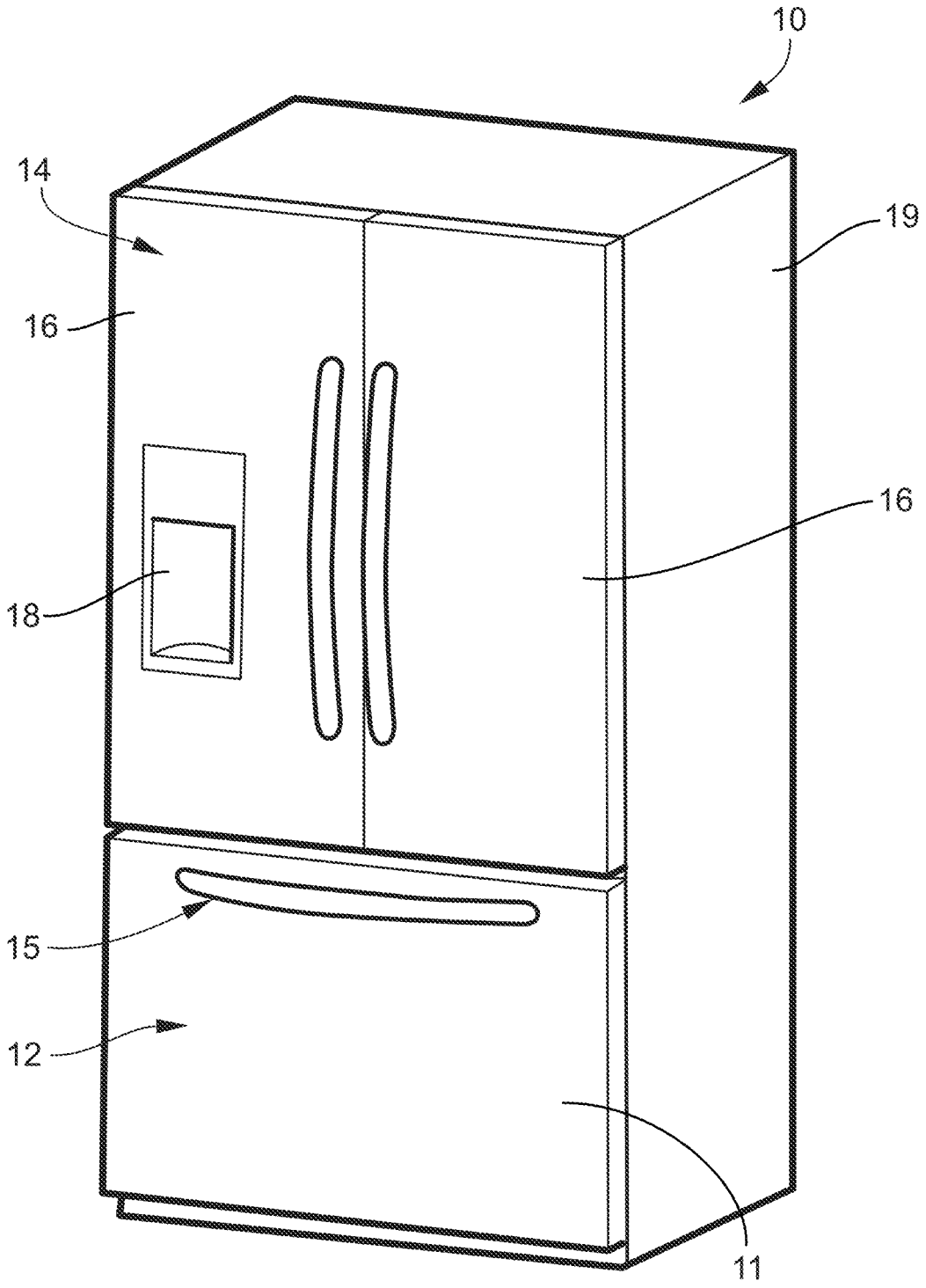
FIG. 1 is a front perspective view of a prior art household French door bottom mount refrigeration appliance showing doors of the fresh food compartment and drawer of a freezer compartment in a closed position.

Embodiments of a refrigerator or a component thereof now will be described with reference to the accompanying drawings. Whenever possible, the same reference numerals are used throughout the drawings to refer to the same or like parts.

Figure 2:
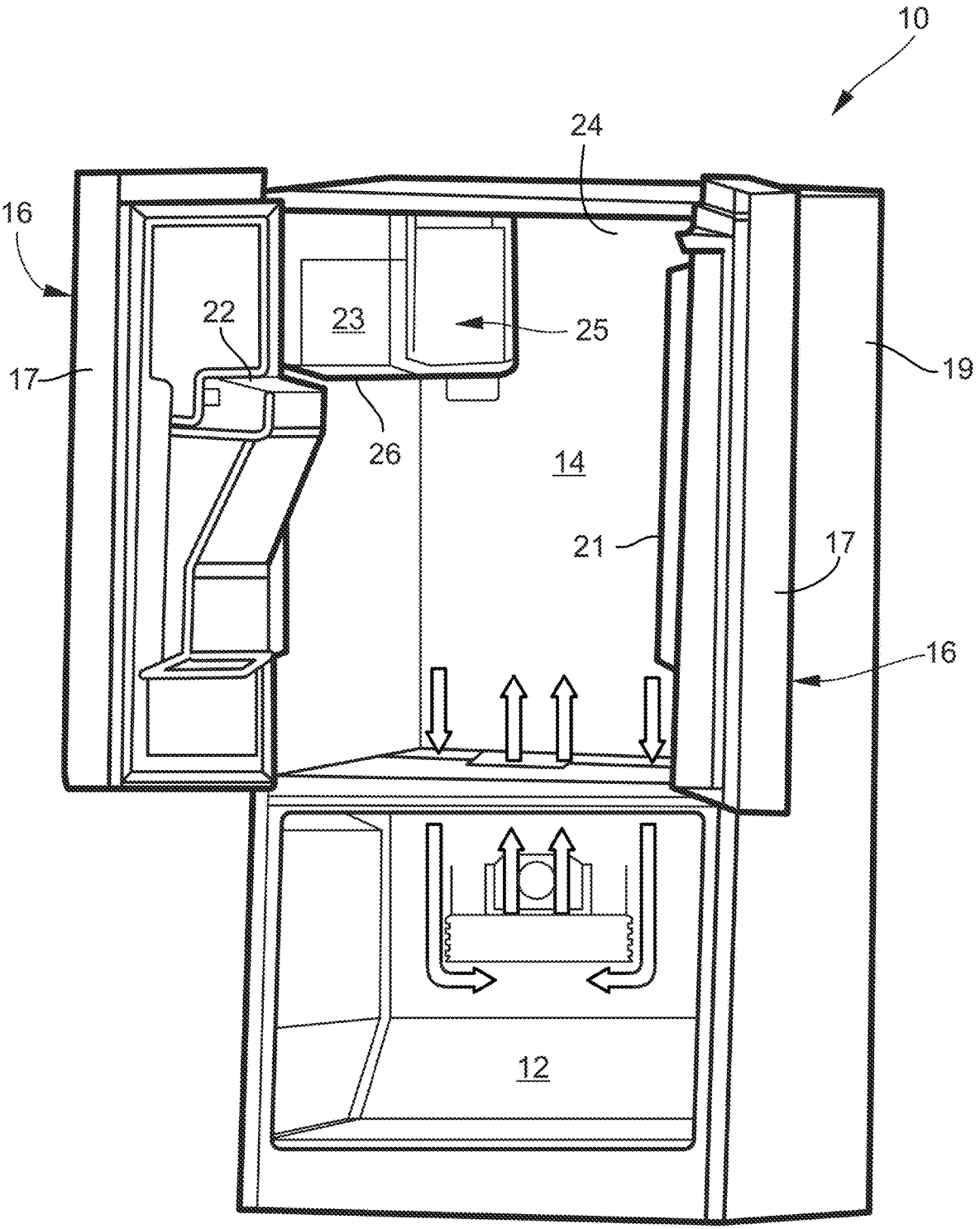
FIG. 2 is a front perspective view of the prior art refrigeration appliance of FIG. 1 showing the doors of the fresh food compartment in opened positions and the drawer of the freezer compartment removed.

Referring now to the drawings, FIGS. 1 and 2 show a refrigeration appliance in the form of a domestic refrigerator, indicated generally at 10. Although the detailed description that follows concerns a domestic refrigerator 10, the invention can be embodied by refrigeration appliances other than a domestic refrigerator 10. An embodiment is described in detail below and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a side-by-side refrigerator (fresh food compartment is laterally next to the freezer compartment), a standalone refrigerator or freezer, etc.

One or more doors 16 shown in FIG. 1 are pivotably coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14.

For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotably coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation and forms an angle other than parallel relative to the door 16 when the center mullion 21 is in the second orientation. The seal and the externally exposed surface of the mullion 21 cooperate approximately midway between the lateral sides of the fresh food compartment 14.

A dispenser 18 (FIG. 1) for dispensing at least ice pieces, and optionally water, can be provided on an exterior of one of the doors 16 that restricts access to the fresh food compartment 14. The dispenser 18 includes an actuator (e.g., lever, switch, proximity sensor, etc.) to cause frozen ice pieces to be dispensed from an ice bin 23 (FIG. 2) of an ice maker 25 disposed within the fresh food compartment 14.

Ice pieces from the ice bin 23 can exit the ice bin 23 through an aperture 26 and be delivered to the dispenser 18 via an ice chute 22 (FIG. 2), which extends at least partially through the door 16 between the dispenser 18 and the ice bin 23. The operation of the automatic dispenser is discussed in greater detail below.

The freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this aim by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C.

According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 14 independent of the freezer compartment 12.

According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

Figure 3:
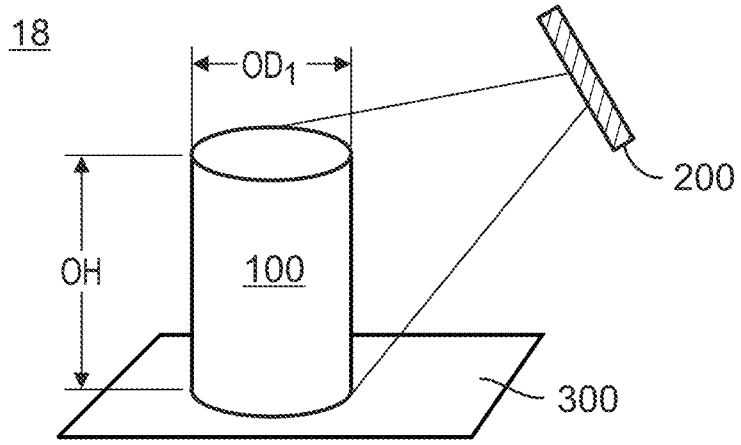
FIG. 3 is an illustration of an embodiment of the instant invention where the object has a cylindrical shape.
Figure 4:
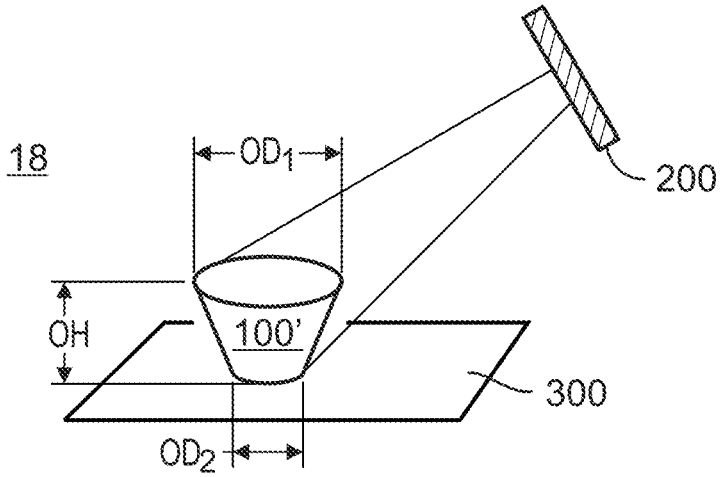
FIG. 4 is an illustration of an embodiment of the instant invention where the object has a frustum shape.
Figure 5:
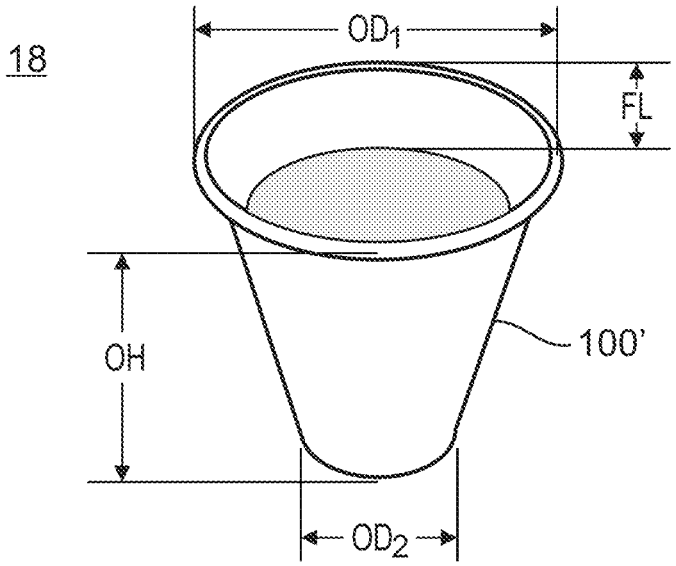
FIG. 5 is an illustration of another embodiment of the instant invention where the object has a frustum shape.

Referring to FIGS. 3-5, the instant invention will be discussed. In general, the method (and/or the associated apparatus for executing the method) may include: visually (or optically) estimating the volume of the container ($V_c$); converting $V_c$ to weight $W_c$; and filling the container to We. Alternatively, the method (and/or the associated apparatus for executing the method) may include: visually (or optically) estimating the exterior volume of the container ($V_e$); visually estimating the wall thickness of the container ($V_w$); determining the interior volume of the container ($V_w$), where $V_i=(V_e-V_w)$; converting $V_w$ to a weight ($W_i$); and filling the container to $W_i$.

Dispenser 18 is conventional and additionally includes a camera 200 and a weight sensor 300, both of which are conventional. Camera 200 is placed so that it can capture an image of the object 100. The captured image is then conventionally analyzed to determine the shape of the object 100 and thereafter determine, for example, the height (OH) and width (e.g., diameter ($OD_1$ and/or $OD_2$) and, in some embodiments, a wall thickness (W). The weight sensor 300 is placed so that the object 100 rests on weight sensor 300 while the object is filled. The weight sensor 300 may be operatively connected to a fill shut-off valve (not shown) for terminating any filling operation of the dispenser.

The calculation of shapes, volumes, and weight is conventional may maybe performed by a microprocessor within the refrigerator or remotely via a cloud-based system via the internet.

Object 100 volumes are conventional and are varied—any volume and combination of volumes may be used. For example, object 100 (FIG. 3) is a cylinder and object 100' (FIGS. 4 and 5) is a frustum. The volumes may be estimated from the height and width of the object. Further, in some embodiments, where a wall thickness is determined, so a more accurate interior object volume may be estimated, in any known manner. The volumes may be estimated by, for example, a numerical method that identifies points on the container to determine the shape of the container and/or a wall thickness of the container.

In some embodiments, after the volume (or internal volume) of the object 100 is determined, a compensation factor, or fill level (FL), may be applied to the estimated volume. This compensation factor is used to reduce the volume so that overfilling is reduced or prevented. The compensation factor may be any value, for example 90% or 95%. The compensation factor may be input by a user or automatically set.

Now that the fill volume is determined, that volume is converted to a weight. The weight may be of water or ice alone or a combination of water and ice. The weights may be estimated based on the known densities of water and ice. The ratio of water and ice may input by a user or automatically set. In one embodiment, when the object 100 is placed onto the weight sensor 300, the weight sensor zeros itself, so that only the filled weight of the container is monitored.

During the fill operation the water and/or ice is dispensed from dispenser 18, in a known manner, into container 100. During the filling operation, the weight of the object 100 is monitored. When the object's weight reaches the determined weight, filling is terminated.

The present invention may be embodied in other forms without departing from the spirit and the essential attributes thereof, and, accordingly, reference should be made to the appended claims, rather than to the foregoing specification, as indicating the scope of the invention.

We claim:

1. A method for automatically filling a container with at least one of water and/or ice from a refrigerator appliance comprising a dispenser configured to dispense said at least one of water and/or ice, a weight sensor configured to receive the container thereon, a camera configured to capture images of the container, and a microprocessor, the method comprising the steps of:

capturing an image, via the camera, of the container placed on the weight sensor;

determining, via the microprocessor, an estimated volume of the container by analyzing the image;

converting, via the microprocessor, the estimated volume to an estimated weight based on density data associated with said at least one of water and/or ice;

dispensing said at least one of water and/or ice, via the dispenser, to fill the container with said at least one of water and/or ice;

monitoring, via the weight sensor, an actual weight of the container when filling the container with said at least one of water and/or ice;

terminating the dispensing based on a comparison between the actual weight and the estimated weight; and terminating the dispensing via a valve when the actual weight attains at least 80% of the estimated weight.

2. The method of claim 1, wherein the method further comprises:

identifying, via the microprocessor, points on the container to determine a shape and/or wall thickness of the container; and determining, via the microprocessor, the estimated volume of the container based on the shape and/or wall thickness of the container.

3. The method of claim 1 where the method further comprises:

determining the estimated volume of the container by applying known volume equations.

4. The method of claim 3 wherein the known volume equations are applied to determine the estimated volume for a cylindrical or frustoconical-shaped container.

5. The method of claim 1, wherein the method further comprises:

preventing the container from being overfilled based on a compensation factor applied to the estimated volume of the container.

6. The method of claim 1, wherein the method further comprises determining, via the microprocessor, the estimated volume of the container via a cloud-based application.

7. The method of claim 1, wherein the method further comprises subtracting, via the microprocessor, a weight of the container in an empty state thereof to derive the actual weight.

* * * * *